United States Patent [19]

Karliner et al.

[11] Patent Number: 4,611,941

[45] Date of Patent: Sep. 16, 1986

[54] PRESSURIZED PAINT PAD MOUNTING

[75] Inventors: Rudolf R. Karliner, Minnetonka; Gerald E. Peterson, St. Paul, both of Minn.

[73] Assignee: Wagner Spray Tech Corporation, Minneapolis, Minn.

[21] Appl. No.: 602,132

[22] Filed: Apr. 19, 1984

[51] Int. Cl.[4] ..... B05C 17/00

[52] U.S. Cl. ..... 401/207; 15/145; 15/244 A; 285/330; 401/146; 401/188 R; 401/197; 401/266

[58] Field of Search ..... 401/146, 149, 188 R, 401/197, 207, 205, 266; 15/244 A, 145, 144 R; 285/330

[56] References Cited

U.S. PATENT DOCUMENTS

| | | | |
|---|---|---|---|
| 764,124 | 7/1904 | Hayden | 15/145 X |
| 821,564 | 5/1906 | Wilks et al. | 285/330 |
| 1,691,024 | 11/1928 | Gedge | 401/205 X |
| 2,438,338 | 3/1948 | Horn | 401/205 |
| 2,722,029 | 11/1955 | Barnes et al. | 401/197 |
| 3,457,017 | 7/1969 | Bastian | 401/146 |
| 3,640,630 | 2/1972 | Walker | 401/188 |
| 3,690,779 | 9/1972 | Ellis | 401/188 X |
| 3,713,184 | 1/1973 | Leland | 15/145 X |
| 3,776,645 | 12/1973 | Walker | 401/188 |

FOREIGN PATENT DOCUMENTS

| | | | |
|---|---|---|---|
| 2914030 | 10/1979 | Fed. Rep. of Germany | 401/197 |

*Primary Examiner*—Steven A. Bratlie

*Attorney, Agent, or Firm*—Hill, Van Santen, Steadman & Simpson

[57] ABSTRACT

A pressurized paint supply system for delivering paint or other coating material under pressure to a variety of interchangeable paint applicators. The invention is also concerned with an improved pad assembly for trimming purposes and to an improved pressure-tight joint which can be used with any of the accessories used in the system of the present invention.

4 Claims, 9 Drawing Figures

PRESSURIZED PAINT PAD MOUNTING

BACKGROUND OF THE INVENTION

1. Field of the Invention

The present invention is in the field of pressurized paint supply systems and provides an integrated collection of interchangeable accessories.

2. Description of the Prior Art

Pressurized systems for dispensing paint and other coating materials have become increasingly popular in recent years. Pressurized paint systems significantly decrease the time required for painting a given area without sacrificing and, in many instances, improving the quality of the coating as compared with a manually operated paint roller.

While there have been numerous systems described for applying pressurized paint to a roller, it became evident that a completely integrated system including other paint dispensing mechanisms beside a roller would be necessary in order to provide a completely sufficient paint applicator system for meeting different painting conditions. Satisfaction of this need is the principal objective of the present invention.

SUMMARY OF THE INVENTION

The present invention provides an improved pressurized painting system which can be marketed in the form of a kit. It provides a canister capable of being internally pressurized in combination with a hand held handle which has inlet and outlet fittings together with an operating switch for controlling the flow of paint. A flexible hose has one end arranged to be connected to the canister and its other end arranged to be connected to the handle. Paint applicator attachments are provided which each have a connector thereon arranged to engage the outlet fitting on the handle in pressure-tight relationship, the attachments including at least one paint roller, a handle extension, a trim pad and a brush. The connector on each of the attachments is identically conformed so that each of the attachments is readily interchangeable with the others.

The present invention is also directed to an improved pad assembly for connection to the pressurized paint supply system. This pad assembly includes a hollow arm, with a paint delivery tube which is secured coaxially within the arm and has an end portion extending therebeyond. A pad support includes a housing which receives the end portion therein and carries an absorbent pad forming the paint applicator surface. Locking means are provided which cooperate between the pad support and the hollow arm to lock the pad support selectively in a paint applying position wherein the pad support is axially restrained from disengagement with the end portion of the paint delivery tube and a release portion in which the pad support is slidably disengageable from the end portion.

Still further improvements of the present invention are provided in pressure-tight joints comprising a hollow arm having an externally threaded portion, a paint delivery tube supported in coaxial relation within the hollow arm, the arm having a splined cylindrical portion beyond the threaded portion which terminates in a tapered seating face. The end of the paint delivery tube extends slightly beyond the tapered seating face. An internally threaded collar is arranged to engage the hollow arm in threaded engagement. A cylindrical socket coaxial with the collar has slots therein for receiving the splines of said arm and also has a tapered seating face complementary to the tapered seating face of the arm for providing a pressure-tight connection therebetween.

BRIEF DESCRIPTION OF THE DRAWINGS

The present invention will be more completely described in conjunction with the attached sheets of drawings, in which.

DESCRIPTION OF THE PREFERRED EMBODIMENTS

Figure 1:
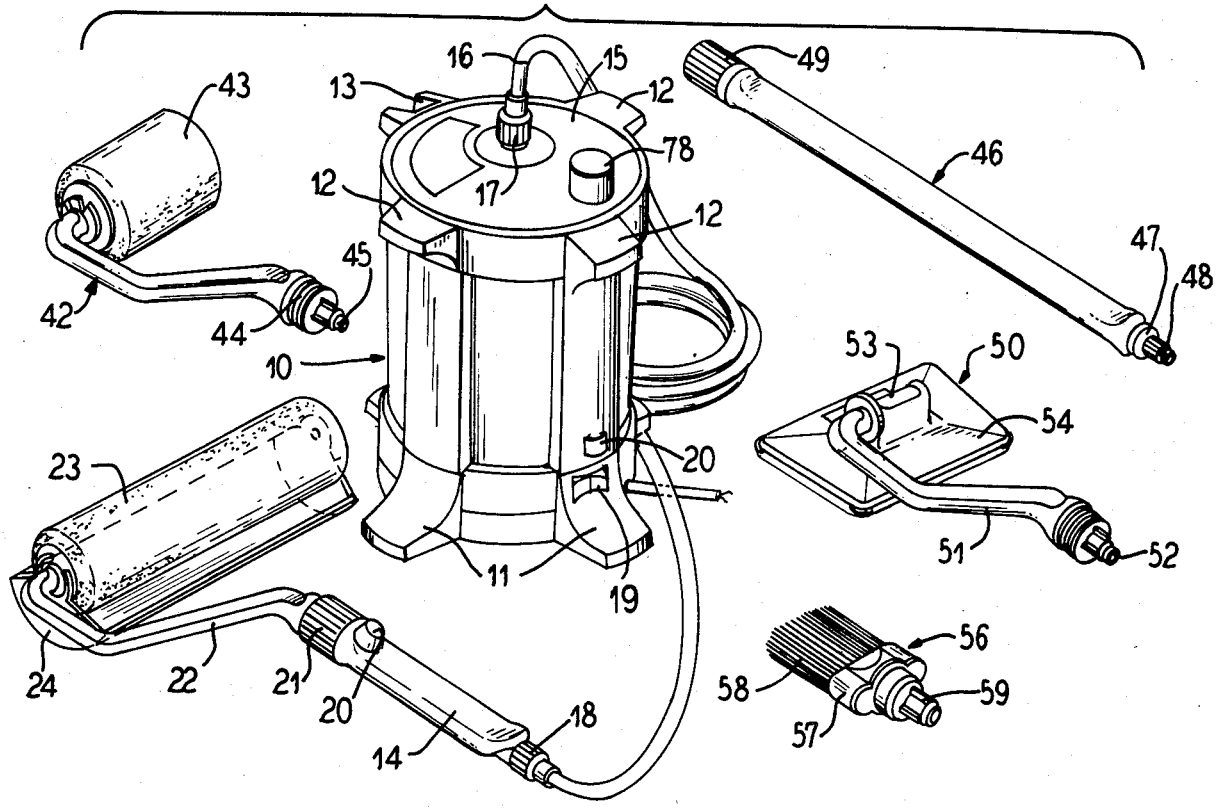
FIG. 1 is a view in perspective of the components of a kit which embodies the improvements of the present invention.

In FIG. 1 reference numeral 10 indicates generally a canister capable of being pressurized and arranged to receive a standard one gallon paint can in its interior. The canister rests on support legs 11 and has peripherally spaced handles 12 about its circumference. One of the handles 12 is provided with a recess 13 to frictionally engage a roller handle 14 and support the paint roller next to the canister 10 when the roller is not in use.

The canister is provided with a removable top 15 through which there extends a flexible paint hose which is connected to the top 15 by means of a connector 17. A pressure and locking relief knob 78 is provided as a safety device to assure that pressure within the canister 10 is relieved before the top 15 is removed.

Figure 2:
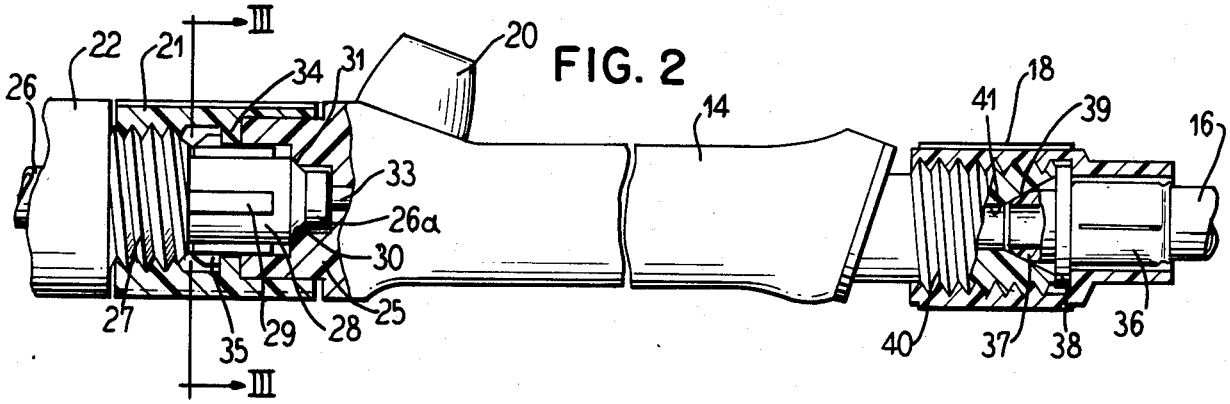
FIG. 2 is a view partly in elevation and partly in cross section of the roller handle assembly included in FIG. 1.

The flexible paint hose 16 enters the roller handle 14 through a connector 18 which is best illustrated in FIG. 2 and will be described in a succeeding portion of this specification.

Near the base of the canister 10 there is a high-low selector switch 19 for determining the speed of a motor-compressor unit (not shown) located in the base of the canister 10. Generally, a high speed is desired for operation with a roller, while a low speed is more desirable for use with the attachments. A hose clamp 20 is provided to hold the hose 16 against the canister at a low position so that pulling on the hose 16 would not be likely to tip over the entire canister.

The roller handle 14 has an operating valve 20 which controls the flow of pressurized paint through the handle 14. A cinch knob collar 21 connects the handle 14 with the particular painting attachment being used. Shown connected to the roller handle 14 in FIG. 1 is a large paint roller assembly including a roller arm 22 which feeds paint under pressure to the interior of a hollow paint roller 23. A roller tray 24 of generally semicircular cross section is provided to support the ends of the roller in spaced relation to the bottom of the tray 24 so that the roller can be supported without smearing of the paint when the roller is not in use.

In FIG. 2 there is shown a pressure-tight joint which connects the handle 14 to the roller arm 22. The roller arm 22 has a paint delivery tube 26 supported in coaxial relation within the hollow arm and a threaded cylindrical portion 27 which is received in threaded engagement within the interiorly threaded cinch knob collar 21. Beyond the threaded portion 27 the roller arm has a cylindrical portion 28 on which there are formed a series of circumferentially spaced splines 29. Beyond the splines 29, there is a tapered seating face 30 which is arranged to abut a complementarily shaped seating face 31 in a socket 25 forming the end of the handle 14. An end portion **26*a* of the paint delivery tube 26 extends beyond the tapered seating face 30 and is positioned to effect communication with a passage 33 in the handle 14**.

Figure 3:
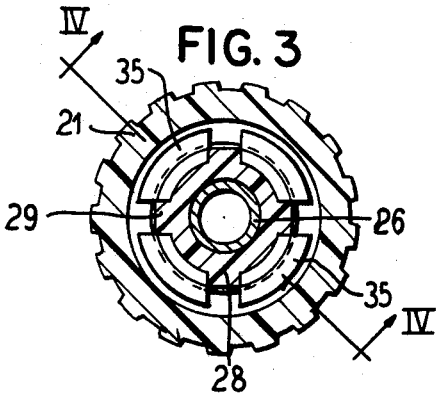
FIG. 3 is a cross-sectional view taken substantially along the line III—III of FIG. 2.
Figure 4:
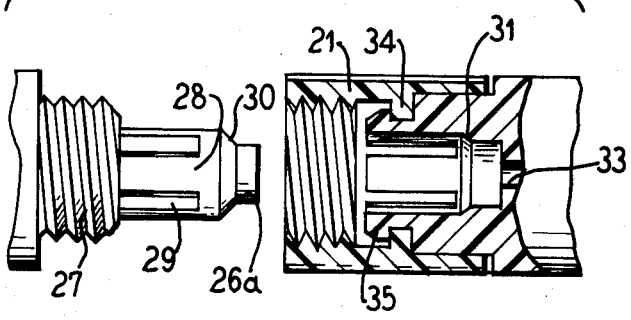
FIG. 4 is an exploded view of the connector shown in FIG. 2, in a disengaged position.
Figure 5:
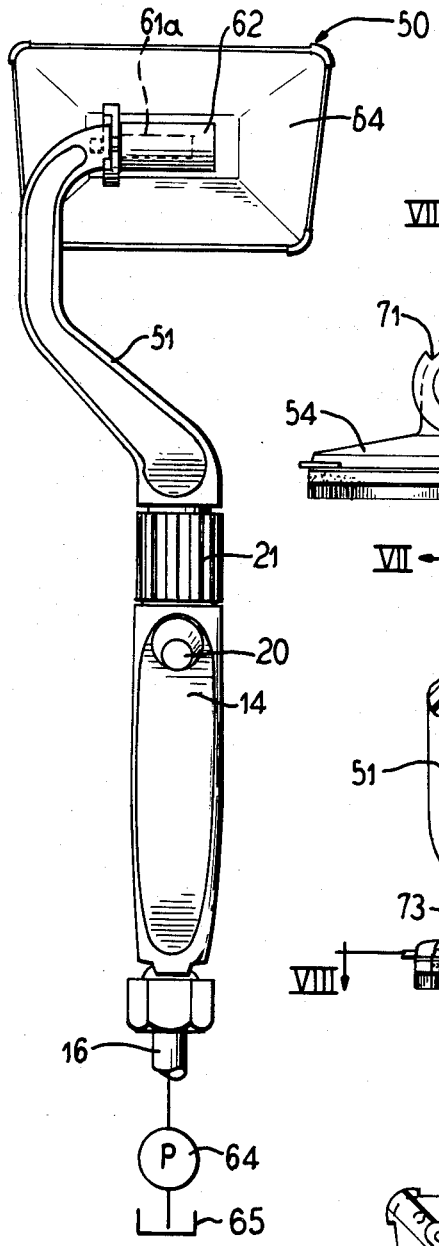
FIG. 5 is a partially schematic view of a trim pad assembly which can be used for the purposes of the present invention.

The collar 21 has a continuous annular flange 34 which is received behind beveled segments 35 in the socket 25 as best shown in FIG. 3, the segments 35 having slots therebetween which receive the splines 29. The annular flange 34 is thus received in a groove which permits rotation of the collar 21 but prevents its axial displacement.

At the other end of the handle 14, the end of the paint hose 16 is received in a metallic ferrule 36 which is crimped about the end of the hose. A frusto-conical element 37 is tightly wedged within the ferrule 36 and has an annular flange portion 38 which prevents it from being withdrawn from the hose connector 18. The hollow element 37 communicates with an axial bore 41 provided at the threaded end 40 of the handle structure 14.

Returning to FIG. 1, there are illustrated several attachments which can be used in place of the relatively large roller shown attached to the handle 14 in FIG. 1. For example, the kit may include a small trim roller 42 with a relatively small roller cover 43 for painting in areas along woodwork and the like. The small trim roller is nevertheless completely interchangeable with the large roller since it is provided with a threaded end portion 44 and a splined connector portion 45 which is identical to the threaded end portion 27 and the splined cylindrical portion 28 shown in FIG. 2. The kit may also include a handle extension 46 when it is desired to use the pressurized paint applicator system on a ceiling. The handle extension 46 has a threaded end portion 47 and a splined connector portion 48 which is received within the socket 25 of the handle 14. Likewise, the upper end of the extension 46 has a connector 49 configured to receive the threaded end portion and splined shaft portion of any of the attachments.

One of the additional improvements provided by the present invention is concerned with a trim pad generally indicated at reference numeral 50. The pad has a handle portion 51 in which a paint delivery tube 52 extends in coaxial relation. The end of the handle 51 is received in a locking means 53 which will serve to lock the pad support 54 selectively in a paint applying position wherein the pad support 54 is axially restrained from disengagement with the end portion of the paint delivery tube and a release portion in which the pad support is slidably disengageable from the end portion. The details of the improved trim pad structure are shown in FIGS. 5 to 9, inclusive, as will be discussed in a succeeding portion of this specification.

Finally, there is a brush attachment 56 including a hollow support 57 to which bristles 58 are attached at their butt ends. In common with the other attachments, the brush 56 includes a splined end portion 59 for insertion into the support arm 14 or the extension 46. The trim brush 56 is used in place of a roller for painting of trim, corners and angular or irregular surfaces.

Referring to FIGS. 5 to 9, the improved pad assembly of the present invention includes a hollow arm 51 through which there is received a paint delivery tube 61 secured coaxially within the arm and having an end portion **61*a* extending therebeyond. The pad support 54 is provided with a housing 62 which receives the end portion 61*a*. Paint is delivered into the interior of the housing 62 into a reservoir 63 formed in the interior of the housing. Paint is fed into the reservoir 63 through the paint delivery tube 61 by the action of a pump 64 which delivers paint under pressure from the canister diagrammatically illustrated at reference numeral 65**.

Figure 8:
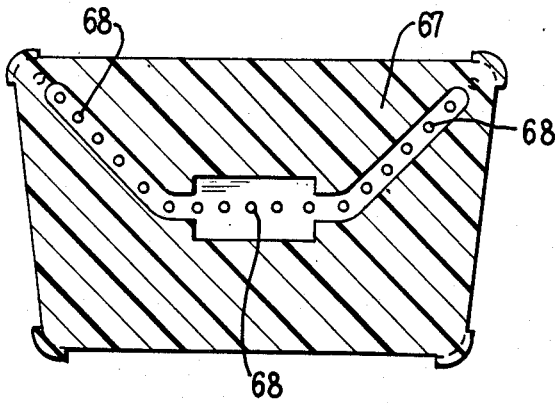
FIG. 8 is a view in elevation of the configuration of the paint-applying surface of the trim pad.
Figure 9:
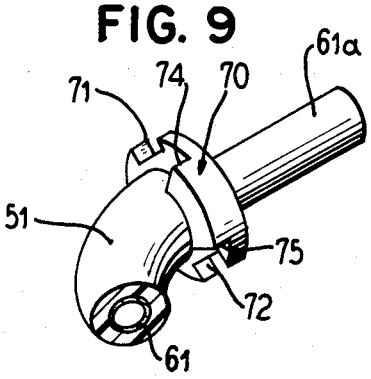
FIG. 9 is a view in perspective of a portion of the pressure-tight joint of the present invention.

A resilient backing 66 is adhesively secured below the reservoir 63. The backing 66 is laminated to a fibrous applicator pad 67 and the backing 66 and the applicator pad 67 are provided with mating apertures 68 which deliver paint to a central portion of the pad 67 and angularly into the corners of the pad as best illustrated in FIG. 8.

Figure 6:
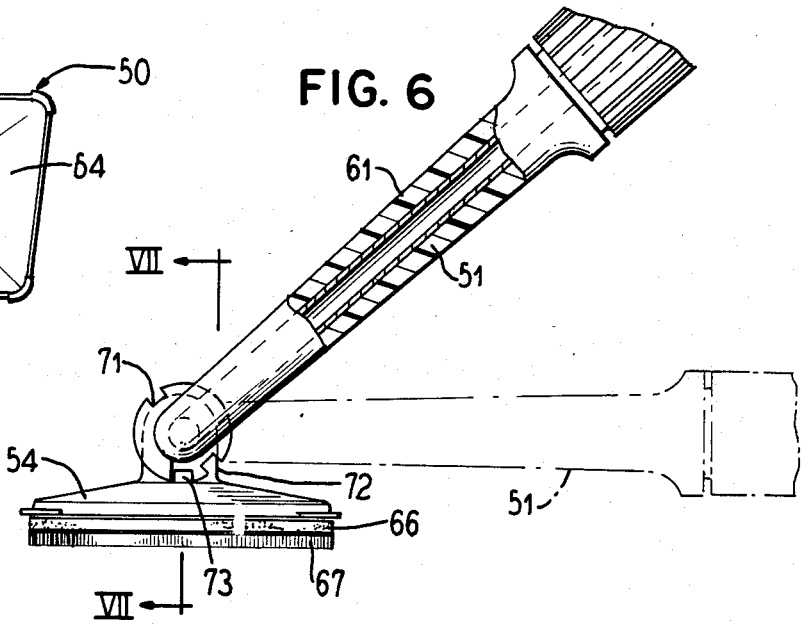
FIG. 6 is a view partially in elevation and partially in cross section illustrating the operation of the locking means used in the present invention.
Figure 7:
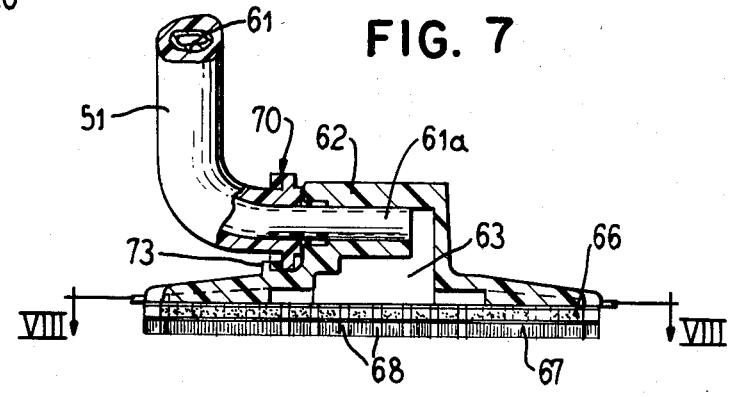
FIG. 7 is a cross-sectional view taken substantially along the line VII—VII of FIG. 6.

One of the features of the trim pad of the present invention is its adjustability between a position in which the pad is in a paint applying position and the pad support is axially restrained from disengagement with the end of the paint delivery tube, and a release portion in which the pad is slidably disengageable from the end portion. FIG. 6 illustrates the two positions, the solid line position being the paint applicator position in which the arm 51 is supported in an adjustable position up to an angle of about 45° with the pad 67 and the dot-dash position illustrates the condition where the arm 51 is substantially parallel to the pad 67 and is capable of being disengaged axially from the housing 62. To accomplish this, there is a disk 70 provided at the end of the support arm 51 and spaced inwardly from the discharge end of the end portion **61*a*. The disk 70 includes a pair of diametrically opposed slots 71 and 72 which are proportioned to slide over a projection 73 formed in the upper portion of the pad support 54. Tapered seating faces 74 and 75 are provided adjacent the slots 71 and 72. When the handle 51 is in the paint applicator position shown in FIG. 6, the projection 73 abuts against one of the surfaces 74 and 75 so that the orientation of the arm 51 relative to the pad is as shown in solid lines in FIG. 6. Since the projection 73 is no longer in registry with either of the slots 71 or 72, the arm 51 is prevented from disengaging axially from the housing 62. Rotating the arm 51 through an angle of about 45°, however, aligns one of the slots 71 or 72 with the projection 73, enabling the arm 51 to be disengaged from the pad structure by pulling the support arm 51 outwardly from the housing 62**.

The improved paint dispenser system of the present invention thereby provides a convenient means for accomplishing different painting functions. The coupling units are such that the various attachments are easily engaged and disengaged from the handle or from an extension secured to the handle. The present invention also provides an improved pad assembly for connection to such a pressurized paint system and a pressure-tight joint for coupling the various attachments to the handle.

It should be evident that various modifications can be made to the described embodiments without departing from the scope of the present invention.

We claim as our invention:

1. A pad assembly for connection to a pressurized paint supply system comprising a hollow arm, a paint delivery tube secured coaxially within said arm and having an end portion extending therebeyond, a pad support having a housing receiving said end portion therein, an absorbent pad carried by said pad support, and locking means cooperating between said pad support and said hollow arm to position said pad support selectively in a paint applying angularly adjustable position wherein said pad support is axially restrained from disengagement with said end portion and a release position in which said pad support is slidably disengageable in its entirety from said end portion, said locking means including a disk at the end of said hollow arm having at least one slot therein and stop means angularly spaced from said slot, said pad support having a raised projection thereon over which said slot is slidable in disengaging said pad support from said hollow arm, said stop means preventing axial movement of said pad support when said projection is out of registry with said slot and providing sliding disengagement when in registry with said slot.

2. A pad assembly according to claim 1 wherein said pad has apertures for delivering paint to the center and marginal edges of said pad.

3. A pad assembly according to claim 2 wherein the apertures in said pad extend through a central portion of said pad and angularly to corners of said pad.

4. A pad assembly according to claim 1 wherein said pad support has a generally hollow interior above said pad to provide a paint reservoir for feeding said pad.

* * * * *